US007328471B1

(12) United States Patent
Stohr

(10) Patent No.: US 7,328,471 B1
(45) Date of Patent: Feb. 12, 2008

(54) BEDDING WEDGE SYSTEM

(76) Inventor: Edward A. Stohr, 6124 Kestrelpark Dr., Lithia, FL (US) 33547

( * ) Notice: Subject to any disclaimer, the term of this patent is extended or adjusted under 35 U.S.C. 154(b) by 0 days.

(21) Appl. No.: 11/786,583

(22) Filed: Apr. 12, 2007

(51) Int. Cl.
*A47C 21/06* (2006.01)
*A47G 9/02* (2006.01)

(52) U.S. Cl. ..... 5/660; 5/731; 5/737; 5/925; 5/482

(58) Field of Classification Search ..... 5/660, 5/659, 690, 737, 738, 731, 925, 482, 499
See application file for complete search history.

(56) References Cited

U.S. PATENT DOCUMENTS 1,432,875 A 10/1922 Lavagetto
5,205,005 A 4/1993 Merrill et al.
5,621,931 A * 4/1997 Hamilton ..... 5/493
5,771,515 A 6/1998 Carr
5,987,668 A * 11/1999 Ackley ..... 5/500
6,757,925 B1 7/2004 Toomer
2004/0172763 A1* 9/2004 Sachs et al. ..... 5/656
2006/0230539 A1* 10/2006 Goodman ..... 5/660

* cited by examiner

*Primary Examiner*—Alexander Grosz
(74) *Attorney, Agent, or Firm*—Edward P. Dutkiewicz

(57) ABSTRACT

A mattress surface has planar lower and upper surfaces. The mattress has a forward head surface and a rearward foot surface. The mattress has parallel side surfaces. A box spring assembly is provided in a wedge-shaped configuration. The box spring assembly has planar lower and upper surfaces. The box spring assembly has a forward head surface and a rearward foot surface. The box spring assembly has parallel side surfaces. The thickness of the box spring assembly at the forward head surface is greater than thickness of the box spring assembly at the rearward foot surface.

2 Claims, 4 Drawing Sheets

FIG 1
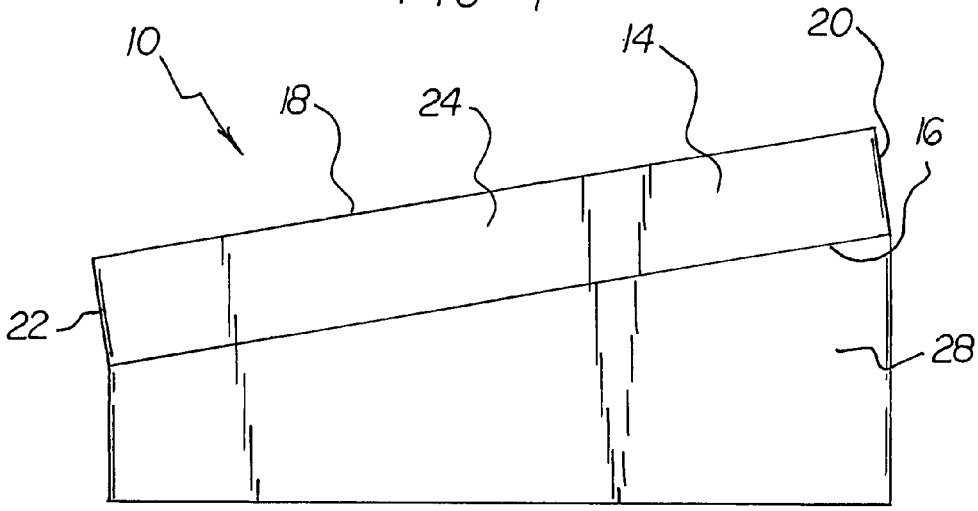
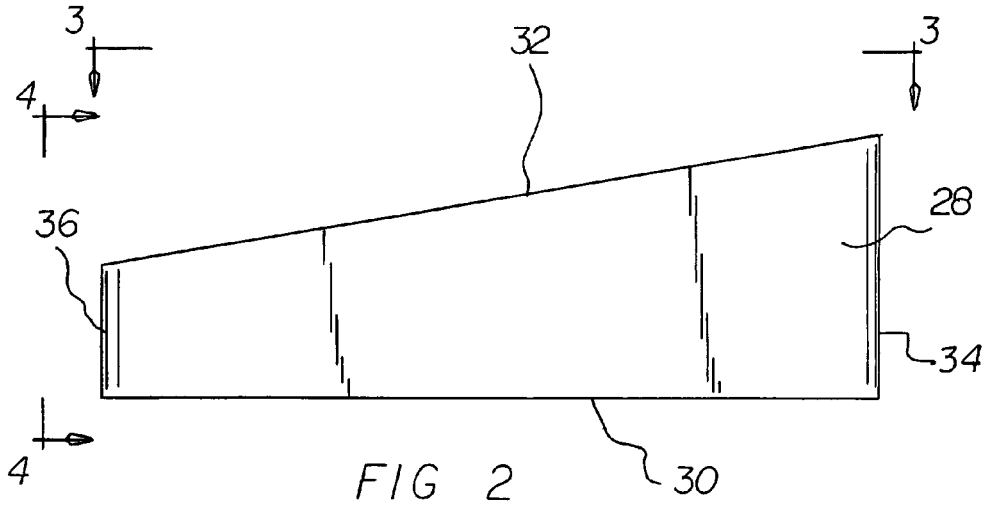
FIG 2

FIG 3
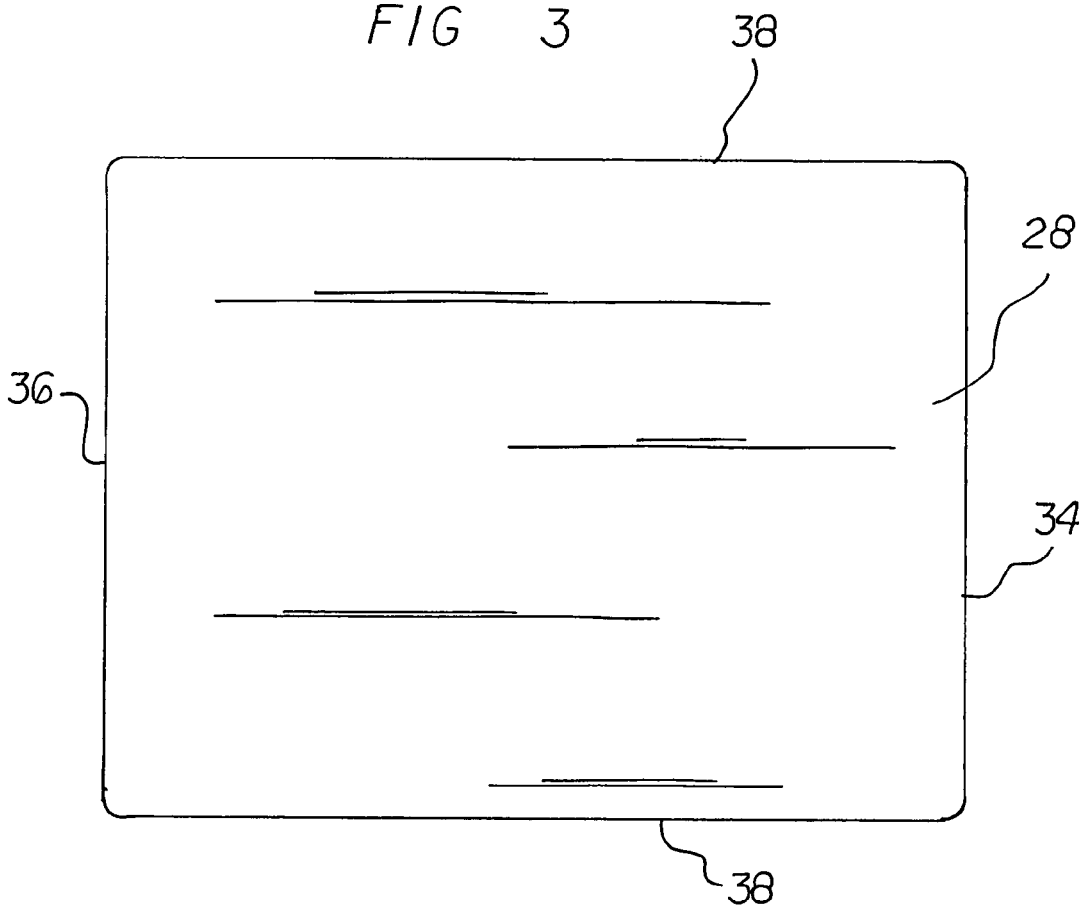
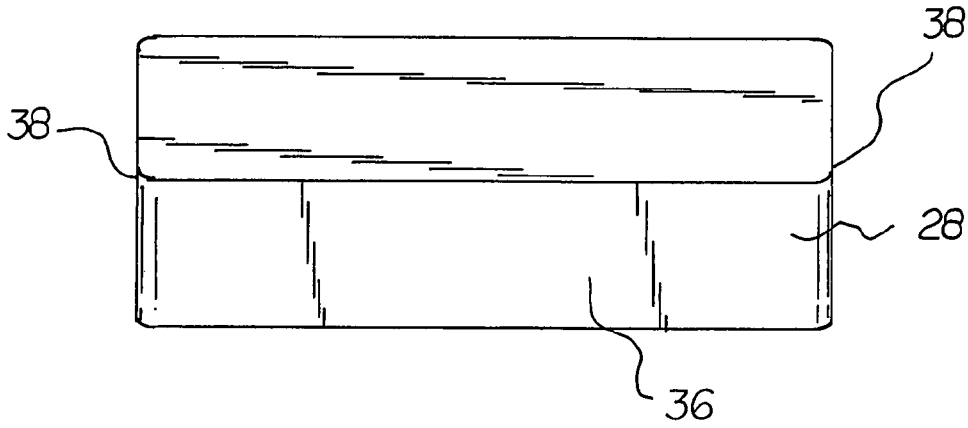
FIG 4

FIG 6
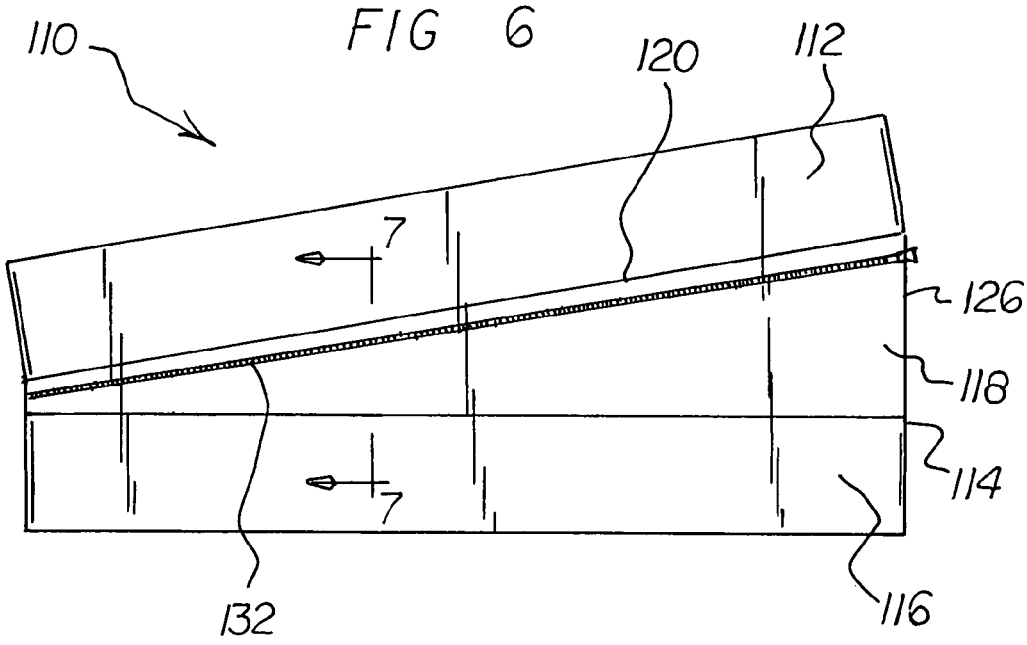
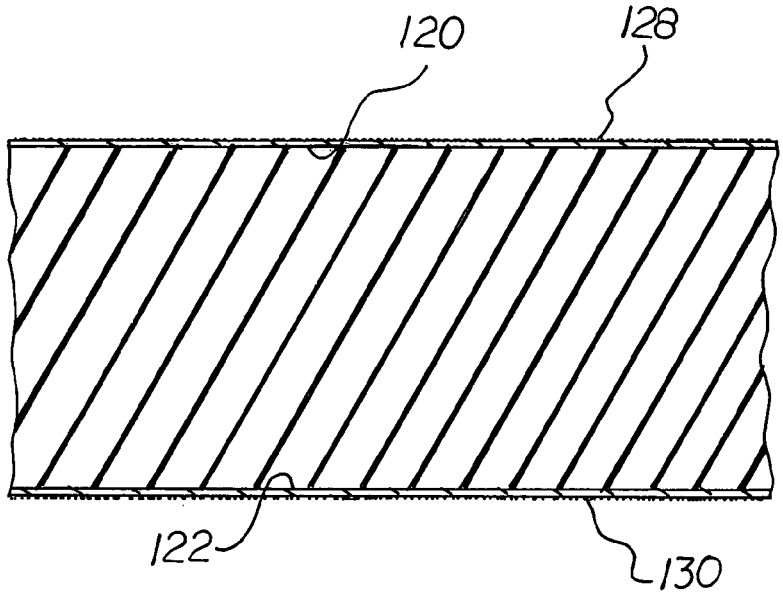
FIG 7

BEDDING WEDGE SYSTEM

BACKGROUND OF THE INVENTION

1. Field of the Invention

The present invention relates to a bedding wedge system and more particularly pertains to supporting a sleeping person at an angle with the head above the feet for increased acid reflux abatement and comfort in a safe and reliable manner.

2. Description of the Prior Art

The use of bedding systems of known designs and configurations is known in the prior art. More specifically, bedding systems of known designs and configurations previously devised and utilized for the purpose of supporting a sleeping person through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,432,875 issued Oct. 22, 1922 to Lavagetto relates to a Mattress. U.S. Pat. No. 5,205,005 issued Apr. 29, 1993 to Merrill relates to a Bed Elevating Apparatus. U.S. Pat. No. 5,771,515 issued Jun. 30, 1998 to Carr relates to a Mattress Elevating Apparatus. Lastly, U.S. Pat. No. 6,767,925 issued Jul. 6, 2004 to Toomer relates to a Mattress Adjusting System.

While these devices fulfill their respective, particular objectives and requirements, the aforementioned patents do not describe a bedding wedge system that allows for supporting a sleeping person at an angle with the head above the feet for increased acid reflux abatement and comfort in a safe and reliable manner.

In this respect, the bedding wedge system according to the present invention substantially departs from the conventional concepts and designs of the prior art, and in doing so provides an apparatus primarily developed for the purpose of supporting a sleeping person at an angle with the head above the feet for increased acid reflux abatement and comfort in a safe and reliable manner.

Therefore, it can be appreciated that there exists a continuing need for a new and improved bedding wedge system which can be used for supporting a sleeping person at an angle with the head above the feet for increased acid reflux abatement and comfort in a safe and reliable manner. In this regard, the present invention substantially fulfills this need.

SUMMARY OF THE INVENTION

In view of the foregoing disadvantages inherent in the known types of bedding systems of known designs and configurations now present in the prior art, the present invention provides an improved bedding wedge system. As such, the general purpose of the present invention, which will be described subsequently in greater detail, is to provide a new and improved bedding wedge system and method which has all the advantages of the prior art and none of the disadvantages.

To attain this, the present invention essentially comprises a bedding wedge system. First provided is a mattress. The mattress is in a rectilinear configuration. The mattress has a planar lower surface. The mattress has a planar upper surface. The upper surface is parallel with the lower surface. In this manner a thickness is defined between the upper and lower surfaces. The mattress has a forward head surface. The mattress has a parallel rearward foot surface. In this manner a length is defined between the head and foot surfaces. The mattress has parallel side surfaces. The side surfaces span the space between the head and foot surfaces. In this manner a width is defined between the side surfaces. The head and foot and side surfaces form a periphery. The head and foot and side surfaces couple the upper and lower surfaces. The mattress is fabricated of a resilient construction. In this manner the acid reflux abatement and comfort of a person reclining on the upper surface of the mattress is facilitated.

Provided last is a box spring assembly. The box spring assembly is in a wedge-shaped configuration. The box spring assembly has a planar lower surface. The box spring assembly has a planar upper surface. The upper surface is provided at varying distances from the lower surface. In this manner a thicknesses is provided between the upper and lower surfaces. The box spring has a forward head surface. The box spring has a parallel rearward foot surface. In this manner a length is provided between the head and foot surfaces. The box spring has parallel side surfaces. The side surfaces span the space between the head and foot surfaces. In this manner a width is defined between the side surfaces. The head and foot and side surface form a periphery. The head and foot and side surfaces couple the upper and lower surfaces. The box spring assembly is fabricated of a resilient construction. The box spring assembly supports the mattress. The lower surface of the mattress is supported upon the upper surface of the box spring assembly. In this manner the acid reflux abatement and comfort of a person reclining on the upper surface of the mattress is facilitated. The thickness of the box spring assembly at the forward head surface is greater than thickness of the box spring assembly at the rearward foot surface. In this manner the upper surface of the box spring assembly constitutes about a 12 to 1, plus or minus 10 percent, run to rise ratio along its entire surface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bedding wedge system which has all of the advantages of the prior art bedding systems of known designs and configurations and none of the disadvantages.

It is another object of the present invention to provide a new and improved bedding wedge system which may be easily and efficiently manufactured and marketed.

It is further object of the present invention to provide a new and improved bedding wedge system which is of durable and reliable constructions.

An even further object of the present invention is to provide a new and improved bedding wedge system which is susceptible of a low cost of manufacture with regard to both materials and labor, and which accordingly is then susceptible of low prices of sale to the consuming public, thereby making such bedding wedge system economically available to the buying public.

Even still another object of the present invention is to provide a bedding wedge system for supporting a sleeping person at an angle with the head above the feet for increased acid reflux abatement and comfort in a safe and reliable manner.

Lastly, it is an object of the present invention to provide a new and improved bedding wedge system. A mattress surface has planar lower and upper surfaces. The mattress has a forward head surface and a rearward foot surface. The mattress has parallel side surfaces. A box spring assembly is provided in a wedge-shaped configuration. The box spring assembly has planar lower and upper surfaces. The box spring assembly has a forward head surface and a rearward foot surface. The box spring assembly has parallel side surfaces. The thickness of the box spring assembly at the forward head surface is greater than thickness of the box spring assembly at the rearward foot surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a bedding wedge system, mattress and box spring assembly, constructed in accordance with the principles of the present invention.

FIG. 2 is a side elevational view of the box spring assembly shown in FIG. 1.

FIG. 3 is a plan view of the box spring assembly taken along line 3-3 of FIG. 2.

FIG. 4 is a rear elevational view of the box spring assembly taken along line 4-4 of FIG. 2.

FIG. 6 is a side elevational view of a bedding wedge system, mattress and box spring assembly, constructed in accordance with an alternate embodiment of the present invention.

FIG. 7 is a cross sectional view taken along line 7-7 of FIG. 6.

The same reference numerals refer to the same parts throughout the various Figures.

DESCRIPTION OF THE PREFERRED EMBODIMENT

Figure 5:
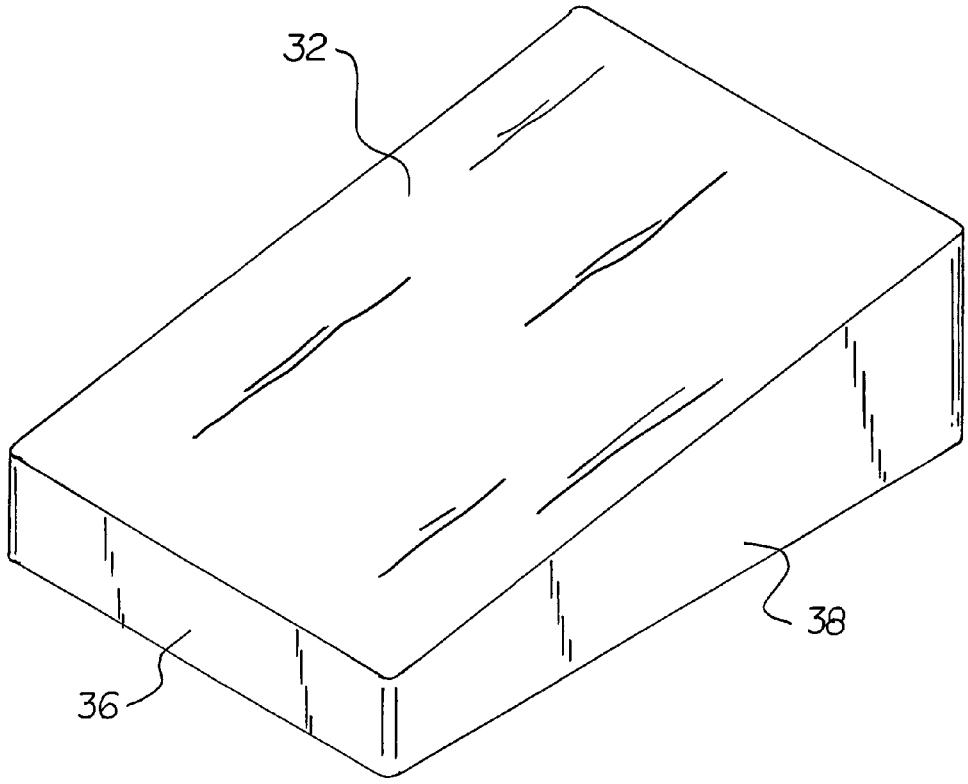
FIG. 5 is a perspective illustration of the box spring assembly shown in the prior Figures.

With reference now to the drawings, and in particular to FIG. 1 thereof, the preferred embodiment of the new and improved bedding wedge system embodying the principles and concepts of the present invention and generally designated by the reference numeral 10 will be described.

The present invention, the bedding wedge system 10 is comprised of a plurality of components. Such components in their broadest context include a mattress and a box spring assembly. Such components are individually configured and correlated with respect to each other so as to attain the desired objective.

First provided is a mattress 14. The mattress is in a rectilinear configuration. The mattress has a planar lower surface 16. The mattress has a planar upper surface 18. The upper surface is parallel with the lower surface. In this manner a thickness is defined between the upper and lower surfaces. The mattress has a forward head surface 20. The mattress has a parallel rearward foot surface 22. In this manner a length is defined between the head and foot surfaces. The mattress has parallel side surfaces 24. The side surfaces span the space between the head and foot surfaces. In this manner a width is defined between the side surfaces. The head and foot and side surfaces form a periphery. The head and foot and side surfaces couple the upper and lower surfaces. The mattress is fabricated of a resilient construction. In this manner the acid reflux abatement and comfort of a person reclining on the upper surface of the mattress is facilitated.

Provided last is a box spring assembly 28. The box spring assembly is in a wedge-shaped configuration. The box spring assembly has a planar lower surface 30. The box spring assembly has a planar upper surface 32. The upper surface is provided at varying distances from the lower surface. In this manner a thicknesses is provided between the upper and lower surfaces. The box spring has a forward head surface 34. The box spring has a parallel rearward foot surface 36. In this manner a length is provided between the head and foot surfaces. The box spring has parallel side surfaces 38. The side surfaces span the space between the head and foot surfaces. In this manner a width is defined between the side surfaces. The head and foot and side surface form a periphery. The head and foot and side surfaces couple the upper and lower surfaces. The box spring assembly is fabricated of a resilient construction. The box spring assembly supports the mattress. The lower surface of the mattress is supported upon the upper surface of the box spring assembly. In this manner the acid reflux abatement and comfort of a person reclining on the upper surface of the mattress is facilitated. The thickness of the box spring assembly at the forward head surface is greater than thickness of the box spring assembly at the rearward foot surface. In this manner the upper surface of the box spring assembly constitutes about a 12 to 1, plus or minus 10 percent, run to rise ratio along its entire surface.

An alternate embodiment of the present invention is a system 110 illustrated in FIGS. 6 and 7. In such system, a mattress 112 is provided. The mattress is of a resilient construction. The mattress is in a rectilinear configuration. A box spring assembly 114 is provided. The box spring assembly is of a two piece construction. The box spring assembly has a lower component 116. The lower component is fabricated of a resilient construction. The lower component is formed in a rectilinear configuration. The box spring has an upper component 118. The upper component is fabricated of a resilient construction. The upper component is formed in a wedge-shaped configuration. The upper component includes a planar upper surface 120. The upper surface supports the mattress. The upper component includes a lower surface 122. The lower surface is received upon the lower component. The system further includes a flexible fabric cover 126. The cover is of a size and shape to encompass the upper component. The cover has an upper anti-slip layer 128. The upper anti-slip layer is provided above the upper surface of the upper component. In this manner slipping between the upper component and the mattress is abated. The cover has a lower anti-slip layer 130. The lower anti-slip layer is provided beneath the lower surface of the upper component. In this manner slipping between the upper component and the lower component is abated. The cover includes a zipper 132. The zipper is provided along the length of one side of the upper component. In this manner removal of the cover for laundering purposes is allowed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bedding wedge system comprising:

a mattress surface of rectilinear construction in a rectilinear configuration, having planar lower and upper surfaces and having a forward head surface and a rearward foot surface with parallel side surfaces; and a box spring assembly in a wedge-shaped configuration and having planar lower and upper surfaces and having a forward head surface and a rearward foot surface with parallel side surfaces, the thickness of the box spring assembly at the forward head surface being greater than thickness of the box spring assembly at the rearward foot surface;

the box spring assembly being of a two piece construction, with a lower component fabricated of a resilient construction and formed in a rectilinear configuration, and an upper component fabricated of a resilient construction and formed in a wedge shaped configuration, the upper component including a planar upper surface supporting the mattress and a lower surface received upon the lower component, the system further including a flexible fabric cover of a size and shape to encompass the upper component with an upper anti-slip layer above the upper surface of the upper component to abate slipping between the upper component and the mattress and a lower anti-slip layer beneath the lower surface of the upper component to abate slipping between the upper component and the lower component, the cover including a zipper along the length of one side of the upper component to allow removal of the cover for laundering purposes.

2. The system as set forth in claim 1 wherein the upper surface of the box spring assembly constitutes about a 12 to 1, plus or minus 10 percent, run to rise ratio along its entire surface.

* * * * *